US008461488B2

(12) United States Patent
Jeong et al.

(10) Patent No.: US 8,461,488 B2
(45) Date of Patent: Jun. 11, 2013

(54) OVEN

(75) Inventors: Eui Seog Jeong, Changwon (KR); Soo Cheol Yi, Changwon (KR)

(73) Assignee: LG Electronics, Inc., Seoul (KR)

( * ) Notice: Subject to any disclaimer, the term of this patent is extended or adjusted under 35 U.S.C. 154(b) by 529 days.

(21) Appl. No.: 12/523,411

(22) PCT Filed: Nov. 15, 2007

(86) PCT No.: PCT/KR2007/005745

§ 371 (c)(1),
(2), (4) Date: Jul. 21, 2010

(87) PCT Pub. No.: WO2008/105581

PCT Pub. Date: Sep. 4, 2008

(65) Prior Publication Data

US 2010/0282731 A1 Nov. 11, 2010

(30) Foreign Application Priority Data

| | | |
|---|---|---|
| Jan. 17, 2007 | (KR) | 10-2007-0005046 |
| Jan. 17, 2007 | (KR) | 10-2007-0005048 |
| Jan. 17, 2007 | (KR) | 10-2007-0005049 |
| Jan. 17, 2007 | (KR) | 10-2007-0005050 |
| Jan. 17, 2007 | (KR) | 10-2007-0005051 |
| Feb. 23, 2007 | (KR) | 10-2007-0018251 |

(51) Int. Cl.
*A21B 1/26* (2006.01)

(52) U.S. Cl.
USPC ..... 219/400; 219/399

(58) Field of Classification Search
USPC ..... 219/394, 399, 400
See application file for complete search history.

(56) References Cited

U.S. PATENT DOCUMENTS

| | | | | |
|---|---|---|---|---|
| 4,467,777 | A | 8/1984 | Weber | |
| 5,036,179 | A | 7/1991 | Westerberg et al. | |
| 6,943,321 | B2 * | 9/2005 | Carbone et al. | 219/400 |
| 7,071,448 | B1 * | 7/2006 | Kim et al. | 219/394 |
| 7,129,447 | B1 | 10/2006 | Kim et al. | |
| 7,442,901 | B2 | 10/2008 | Kim et al. | |
| 2004/0040950 | A1 * | 3/2004 | Carbone et al. | 219/400 |
| 2004/0060927 | A1 | 4/2004 | Kim et al. | |
| 2004/0222208 | A1 | 11/2004 | Ko | |
| 2006/0113294 | A1 | 6/2006 | Lomaglio et al. | |
| 2006/0185527 | A1 | 8/2006 | Shei | |
| 2008/0149088 | A1 | 6/2008 | Inada et al. | |

FOREIGN PATENT DOCUMENTS

| | | | |
|---|---|---|---|
| CN | 1485575 | A | 3/2004 |
| CN | 1502856 | A | 6/2004 |
| CN | 1691890 | A | 11/2005 |
| CN | 1779331 | A | 5/2006 |
| EP | 1211914 | A2 | 6/2002 |
| EP | 1437552 | A1 | 7/2004 |
| EP | 1542511 | A1 | 6/2005 |
| EP | 1674796 | A2 | 6/2006 |

(Continued)

*Primary Examiner* — Alexander Ghyka
(74) *Attorney, Agent, or Firm* — Birch, Stewart, Kolasch & Birch, LLP

(57) ABSTRACT

Present embodiments provide an oven. The oven includes a cavity receiving food; a convection assembly provided in plurality, each convection assembly including a heater that heats the food, and a fan blowing air heated by the heater toward the food; and at least one covering member covering at least one of the fans, wherein the fans have respective shafts that are different in height from a bottom surface of the cavity.

6 Claims, 13 Drawing Sheets

FOREIGN PATENT DOCUMENTS

| | | | |
|---|---|---|---|
| EP | 1748255 | A2 | 1/2007 |
| FR | 2847027 | A1 | 5/2004 |
| JP | 6-281148 | A | 10/1994 |
| JP | 9-126463 | A | 5/1997 |
| JP | 9-303791 | A | 11/1997 |
| JP | 11-325478 | A | 11/1999 |
| JP | 2005-226872 | A | 5/2005 |
| KR | 10-2000-0009940 | A | 2/2000 |
| KR | 10-2003-0088652 | A | 11/2003 |
| KR | 10-2007-0096037 | A | 11/2004 |
| KR | 10-2005-0079522 | A | 8/2005 |
| KR | 10-2005-0081371 | A | 8/2005 |
| KR | 10-2006-0008088 | A | 1/2006 |
| KR | 10-2006-0056765 | A | 5/2006 |
| KR | 10-2006-0091857 | A | 8/2006 |
| KR | 10-2006-0098733 | A | 9/2006 |
| KR | 10-2006-0108796 | A | 10/2006 |
| KR | 10-2006-0116563 | A | 11/2006 |
| KR | 10-2006-0120838 | A | 11/2006 |
| KR | 10-2006-0122224 | A | 11/2006 |
| KR | 10-0698203 | B1 | 3/2007 |
| RU | 1606816 | A1 | 11/1986 |
| SU | 2065550 | C1 | 8/1996 |
| WO | WO-2005/066549 | A1 | 7/2005 |

* cited by examiner

OVEN

TECHNICAL FIELD

The present disclosure relates to an oven.

BACKGROUND ART

In general, an oven is an apparatus that cooks foods within a cavity using heat from a heat source. Ovens can largely be categorized into radiation ovens that employ radiating heat from a heat source to cook foods, and convection ovens that employ a fan to circulate heated air to cook food.

A convection oven includes a cavity defining a cooking compartment, a heating chamber into which air from the cavity is supplied, a heater and fan provided in the heating chamber, and a motor that rotates the fan.

Accordingly, when the fan is rotated, the air within the cavity flows into the heating chamber, is heated by the heater in the heating chamber, and is re-supplied into the cavity.

DISCLOSURE OF INVENTION

Technical Problem

Embodiments provide an oven capable of uniformly circulating air heated by a heater within a cavity.

Embodiments also provide an oven that heats air with a plurality of convection heaters to expedite cooking of food.

Embodiments further provide an oven that discharges air heated by a heater in various directions into a cavity, to enable proper cooking of food.

Technical Solution

In one embodiment, an oven includes: a cavity receiving food; a convection assembly provided in plurality, each convection assembly including a heater that heats the food, and a fan blowing air heated by the heater toward the food; and at least one covering member covering at least one of the fans, wherein the fans have respective shafts that are different in height from a bottom surface of the cavity.

In another embodiment, an oven includes: a cavity defining a cooking compartment; a plurality of heaters at an outside of the cavity; a plurality of fans blowing air heated by each of the heaters toward the cavity; a plurality of suctioning holes defined in the cavity, allowing air to flow toward the heaters; and a plurality of discharging holes defined near each suctioning hole, to discharge the air heated by the heaters toward the cavity, wherein the suctioning holes are defined at respectively different heights.

In a further embodiment, an oven includes: a cavity defining a cooking compartment; a plurality of heaters and a plurality of fans within the cavity; and at least one covering member coupled to an inner side of the cavity, and covering at least one of the heaters and one of the fans, wherein the covering member defines at least one suctioning hole and at least one discharging hole.

Advantageous Effects

According to disclosed embodiments, because a plurality of heaters and fans can operate independently, heated air can be evenly distributed within a cavity.

Also, because a plurality of heaters and fans are disposed above and below one another, air within a cavity can be more evenly distributed.

Moreover, because air heated by a plurality of heaters is discharged in various directions into a cavity, many types of food can be properly cooked.

Further, because a plurality of heaters and fans are disposed separately at different locations, when the plurality of heaters and fans are operated simultaneously, expedient cooking can be realized.

MODE FOR THE INVENTION

Reference will now be made in detail to the embodiments of the present disclosure, examples of which are illustrated in the accompanying drawings.

Figure 1:
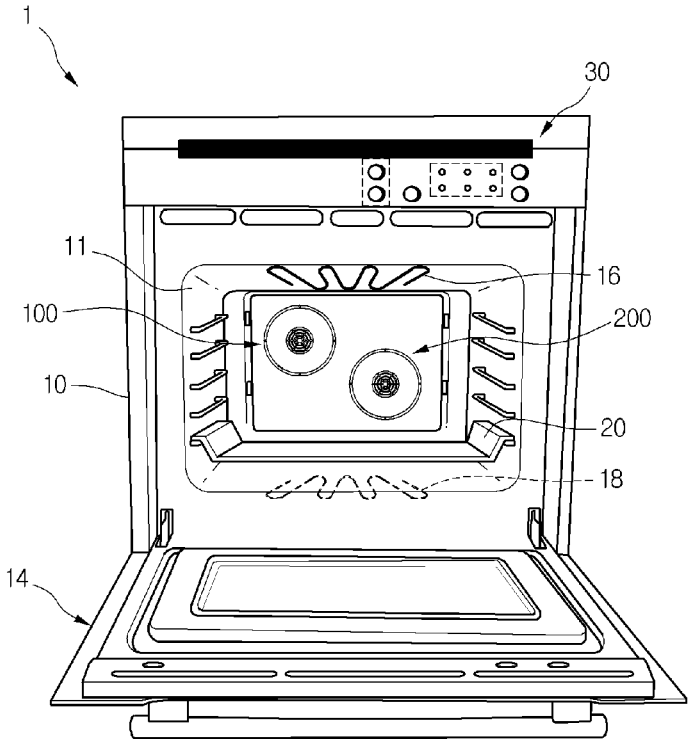
FIG. 1 is a schematic perspective view of an oven according to a first embodiment.
Figure 2:
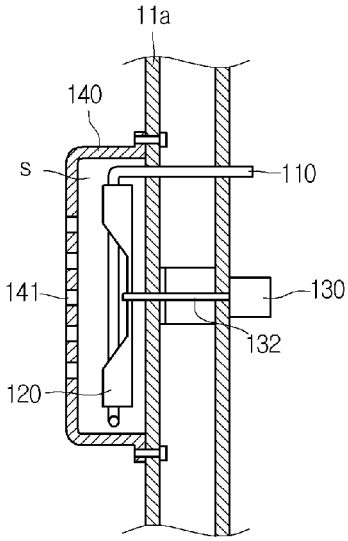
FIG. 2 is a sectional view showing the structure of a convection assembly according to the first embodiment.

FIG. 1 is a schematic perspective view of an oven according to a first embodiment, FIG. 2 is a sectional view showing the structure of a convection assembly according to the first embodiment.

Referring to FIG. 1, an oven 1 according to a first embodiment includes an outer case 10 configuring the exterior thereof, a cavity 11 provided within the outer case 10 to define a cooking compartment, a door 14 for selectively opening or closing the cavity 11, a food supporting portion 20 installed inside the cavity 11 to place food upon, a plurality of heaters to heat food placed on the food supporting portion 20, and a control panel 30 provided on a side of the outer case 10 to allow a user to control the oven.

In detail, a top heater 16 is provided at the top of the cavity 11, and a bottom heater 18 is provided at the bottom of the cavity 11. A plurality of convection assemblies 100 and 200 are provided at the rear of the cavity 11 to discharge heated air into the cavity 11.

Each convection heater 100 and 200 includes a convection fan and a motor, and the air heated by each heater is discharged by the corresponding fan into the cavity 11.

That is, the individual convection assemblies 100 and 200 provided in plurality in the present embodiment discharge heated air into the cavity 11. While the structures of the convection assemblies 100 and 200 in the present embodiment are the same, the convection assemblies are installed in respectively different locations, so that the flow of air is different.

The structure of the convection assemblies 100 and 200 will be described below, and then the relation between the convection assemblies 100 and 200 will be described.

The convection assemblies 100 and 200 may be divided into a left convection assembly 100 and a right convection assembly 200, which will hereinafter be called the first convection assembly 100 and the second convection assembly, respectively.

FIG. 2 depicts the first convection assembly 100 provided at the left, which is equally applicable to the second convection assembly 200 provided at the right.

Referring to FIG. 2, a convection assembly 100 according to the first embodiment includes a convection heater 110, a convection fan 120 that supplies air heated by the convection heater 110 to the cavity 11, and a motor 130 driving the convection fan 120. The convection heater 110 and the convection fan 120 are covered by a covering member 140.

In detail, the covering member 140 is fastened to a cavity rear wall 11*a* of the cavity 11 inside the cavity 11. A space (s) defined by the covering member 140 and the cavity rear wall 11*a* includes the convection heater 110 and the convection fan 120 disposed therein. The space (s) is a heating chamber in which air is heated.

That is, the convection heater 110 and the convection fan 120 are provided within the cavity 11, and the convection fan 120 is coupled to a shaft 132 that passes through from the rear of the cavity 11 and is connected to the motor 130.

The covering member 140 covers the convection heater 110 and the convection fan 120, in order to spatially separate the latter from another convection heater and convection fan provided within the same cavity 11.

Also, because the covering member 140 spatially separates respective convection heaters 110 and convection fans 120, each convection assembly 100 and 200 may operate independently of one another. That is, the operation of the convection heater and convection fan of one convention assembly will not be affected by another convection assembly.

Because the covering member 140 is fastened on the inside of the cavity 11, it projects forward from the cavity rear wall 11*a* in an approximately cylindrical shape.

The front surface of the covering member 140 defines a suctioning hole 141 through which air from within the cavity 11 is suctioned into the space defined by the covering member 140 and the cavity rear wall 11*a*. The peripheral surface (or sides) of the covering member 140 defines a plurality of discharging holes that discharges air heated by the convection heater 110. When the discharging holes are thus formed in the side surface of the covering member 140, the air discharged through the discharging holes is discharged toward both sides of the cavity 11.

When cooking is begun with the above-configured oven, each of the convection heaters and convection fans in the convection assemblies 100 and 200 operates. Then, the air inside the cavity 11 is suctioned through each suctioning hole into the spaces (s). The air flowing into the spaces (s) is heated by the convection heaters, and is discharged through the discharging holes back into the cavity, and food is cooked by the discharged air.

Below, the relationship between the respective convection assemblies 100 and 200 will be described in detail.

Figure 3:
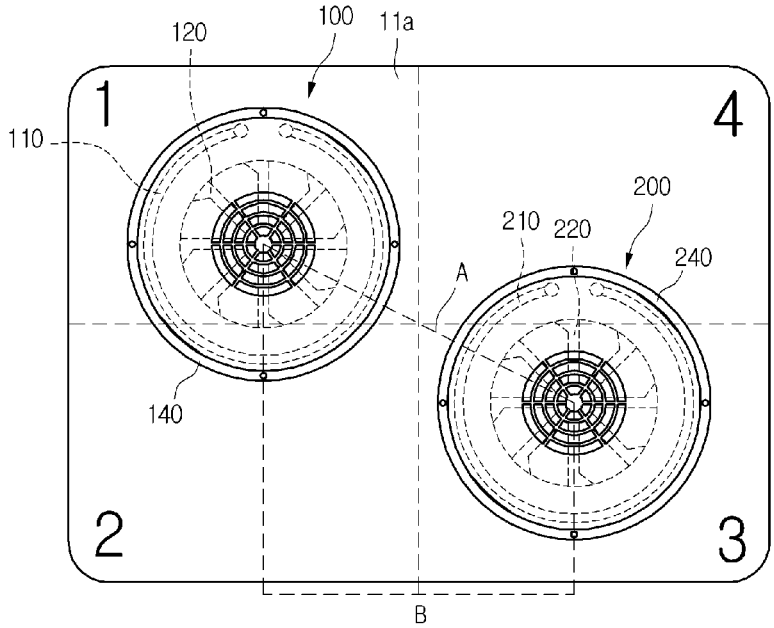
FIG. 3 is a diagram showing the geometric relation between a plurality of convection assemblies according to the first embodiment.

FIG. 3 is a diagram showing the geometric relation between a plurality of convection assemblies according to the first embodiment.

Referring to FIG. 3, as described above, a plurality of convection fans (or convection assemblies) is provided at the rear of the cavity 11, and in the present embodiment, are exemplarily provided as one pair. The locations of each of the pair of convection fans is determined based on two geometric considerations, in order to evenly circulate the heated air inside the cavity 11.

Specifically, the pair of convection fans includes a left convection fan 120 and a right convection fan 220.

The convection fans 120 and 220 are disposed at different heights. That is, the shaft of the left convection fan 120 is located higher than the shaft of the right convection fan 220 when viewed from the front. In the present embodiment, the shaft of the left convection fan 120 may be disposed higher than the shaft of the right convection fan 220, or vice-versa.

That is, a distance of an imaginary first line A between the shafts of the convection fans 120 and 220 is greater than a horizontal projection of the first line A, or, a distance of a second line B connecting the shafts (when viewed downward from above).

When the shafts of the convection fans 120 and 220 are thus disposed at respectively different heights, the air discharged from each of the convection fans 120 and 220 is able to diffuse into the entire interior of the cavity 11.

In order to evenly diffuse heated air within the cavity 11 by means of the convection fans 120 and 220, the convection fans 120 and 220 are disposed on one surface of the cavity to form an approximate point symmetry.

That is, when the cavity rear wall 11*a* is divided into four equal quadrants with a common central angle, the shaft of the left convection fan 120 is disposed within one of the four quadrants. Here, if the quadrant in which the shaft of the left convection fan 120 is disposed is called a first quadrant, the quadrants progressing counterclockwise from the first quadrant may respectively be called a second quadrant, third quadrant, and fourth quadrant.

The shaft of the right convection fan 220 is located in the third quadrant that is diagonal to the first quadrant.

Here, if the shaft of the left convection fan 120 is disposed in the first quadrant and the shaft of the right convection fan 220 is disposed in the second quadrant, the limitation of heated air being concentrated in the left portion within the cavity 11 would occur; and if the shaft of the right convection fan 220 is disposed in the fourth quadrant, the limitation of heated air being concentrated in the upper portion within the cavity 11 would occur.

Therefore, in order to evenly distribute heated air within the cavity 11, the shaft of the right convection fan 220 is disposed in a quadrant that is diagonal to the quadrant in which the shaft of the left convection fan 120 is disposed.

When the convection fans 120 and 220 are located in consideration of the above two factors, air heated by the convection heaters 110 and 210 can be evenly distributed within the cavity 11, allowing for even heating of food.

Figure 4:
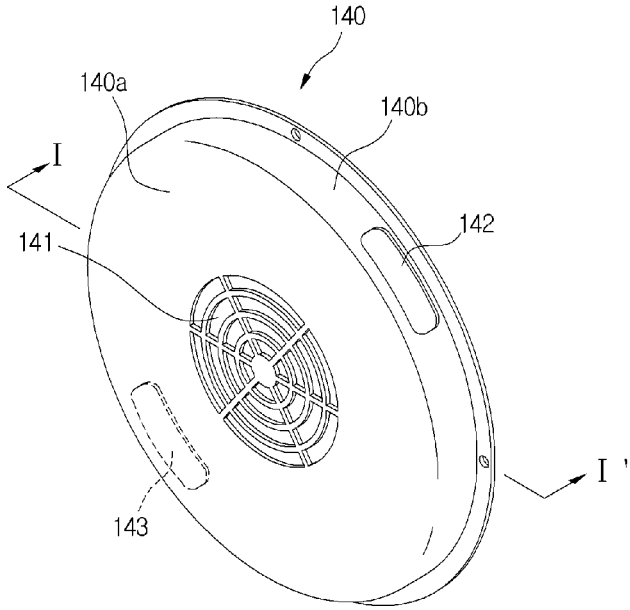
FIG. 4 is a perspective view of a covering member according to the first embodiment.
Figure 5:
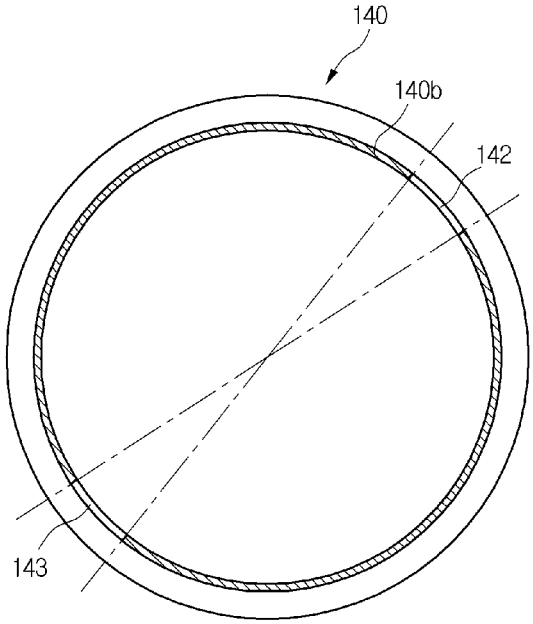
FIG. 5 is a sectional view of FIG. 4 taken along line I-I'.

FIG. 4 is a perspective view of a covering member according to the first embodiment, and FIG. 5 is a sectional view of FIG. 4 taken along line I-I'.

The covering member depicted in FIGS. 4 and 5 may be applied equally as the covering members depicted in the left and right of FIG. 3.

Referring to FIGS. 4 and 5, the covering member 140 includes a front portion 140*a* and a side portion 140*b* extending in an approximately perpendicular direction from the front portion 140*a* to form a cylindrical shape.

A suctioning hole 141 is formed in the center of the front portion 140*a* to allow air inside the cavity 11 to be suctioned into the space (s), and a plurality of discharging holes is formed in the side portion 140*b* to allow air heated by the convection heater 110 to be discharged back into the cavity 11.

In detail, the discharging holes include a first discharging hole 142 formed in the right upper end of the covering member 140, and a second discharging hole 143 formed in the left lower end of the discharging portion 140. The discharging holes 142 and 143 are symmetrical with respect to the center of the covering member 140.

Accordingly, when the convection fan 120 rotates, the air heated by the convection heater 110 passes through the right upper end and the left lower end of the covering member 140 and into the cavity 11.

The relationship between the configuration of the above discharging holes and the location of each convection assembly will be kept in mind in the description of the oven's operation below.

Figure 6:
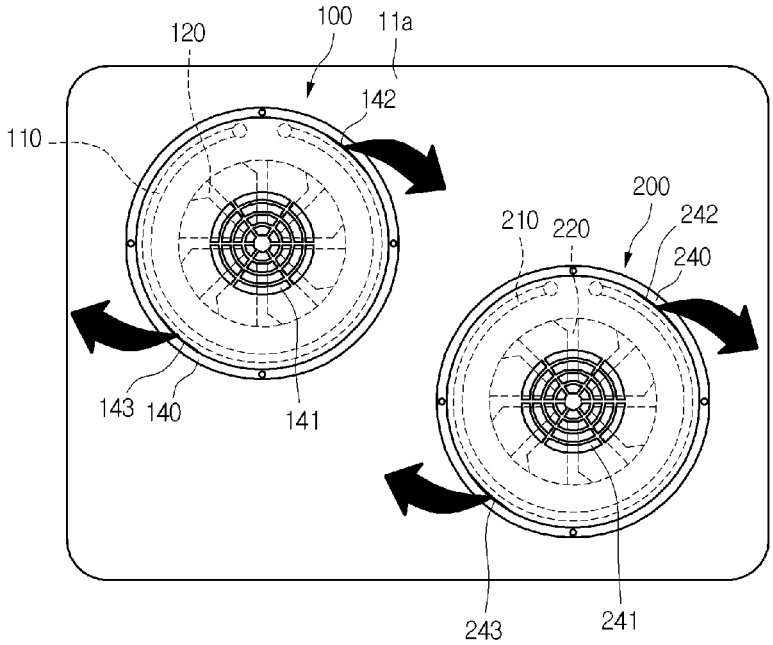
FIG. 6 is a diagram showing the flow of air discharged by convection assemblies according to the first embodiment.

FIG. 6 is a diagram showing the flow of air discharged by convection assemblies according to the first embodiment.

Referring to FIG. 6, when a user stores food in the cavity 11 and presses a start button, each of the convection heaters 110 and 210 radiates heat, and each convection fan 120 and 220 rotates.

Then, the air inside the cavity 11 is suctioned through each suctioning hole 141 and 241 into the respective spaces (s). The air suctioned into each space (s) is heated by each of the convection heaters 110 and 210 and is re-introduced through the respective discharging holes into the cavity 11.

In detail, because the second discharging hole 143 is proximate to the left wall of the cavity 11, when air is discharged through the second discharging hole 143 of the left covering member 140, it is discharged toward the left wall of the cavity 11 and meets the left wall of the cavity 11, whereupon most of the air is directed by the left wall to flow upward to the left.

Also, the air discharged from the first discharging hole 142 of the left covering member 140 flows mostly to the upper right of the cavity 11.

Because the first discharging hole 242 is proximate to the right wall of the cavity 11, when air is discharged by the first discharging hole 242 of the right covering member 240, it is discharged toward the right wall of the cavity 11 and meets the right wall of the cavity 11, whereupon most of it is directed along the right wall in a right, downward direction.

Also, the air discharged from the second discharging hole 243 of the right covering member 240 flows to the left and downward in the cavity 11.

Through the above embodiment, air that is heated by the convection heaters 110 and 210 can be evenly distributed within the cavity 11.

While the convection heaters 110 and 210 and the convection fans 120 and 220 have been described in the present embodiment as all operating when cooking of food is begun, alternatively, the respective convection heaters 110 and 210 and convection fans 120 and 220 may be configured to operate alternatingly, depending on the type of food and stage of cooking.

That is, the process of discharging air heated by the left convection assembly 100 into the cavity 11 and then discharging air heated by the right convection assembly 200 into the cavity 11 may be repeatedly.

In this case, the heated air may be alternatingly concentrated in the upper and lower portions of the cavity 11, which enables even heating in terms of the entire duration of a cooking cycle.

Figure 7:
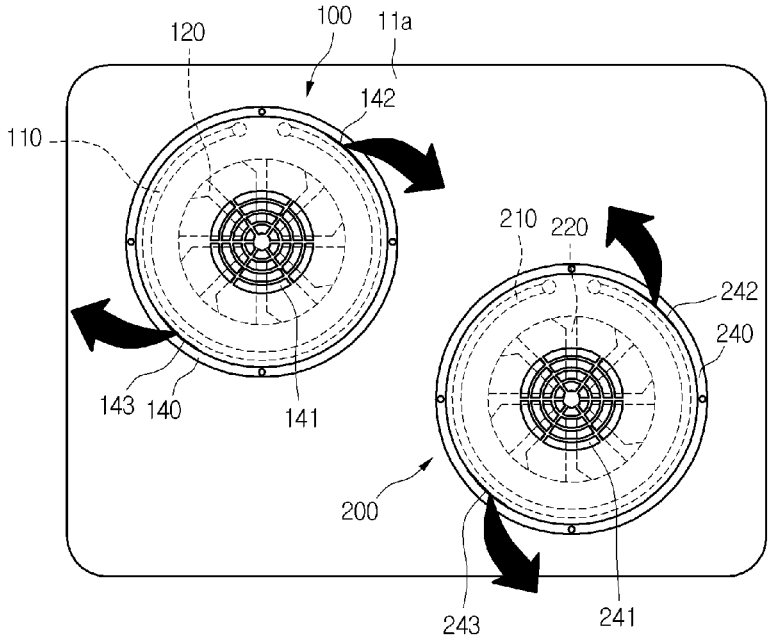
FIG. 7 is a diagram showing the flow of air discharged by convection assemblies according to a second embodiment.

FIG. 7 is a diagram showing the flow of air discharged by convection assemblies according to a second embodiment.

Referring to FIG. 7, the present embodiment is characterized in that the convection fans 120 and 220 rotate in opposite directions. That is, the left convection fan 120, for example, rotates in a clockwise direction, and the right convection fan 220 rotates in a counterclockwise direction.

In this case, the air discharged through the first discharging holes 142 and 242 of each covering member can be uniformly mixed so that heated air can be evenly distributed throughout the cavity 11.

Figure 8:
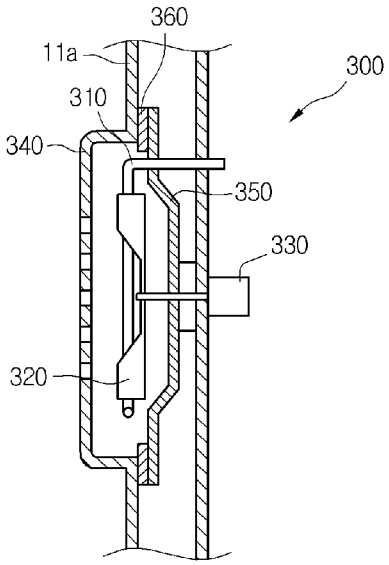
FIG. 8 is a sectional view showing the structure of a convection assembly according to a third embodiment.

FIG. 8 is a sectional view showing the structure of a convection assembly according to a third embodiment.

Referring to FIG. 8, in the present embodiment, the convection heater 310 and convection fan 320 are covered by a covering portion 340 protruding forward from the cavity rear wall 11*a*. The convection heater 310 and convection fan 320 are mounted behind the cavity 11.

Also, a protecting member 350, for protecting the convection heater 310 and convection fan 320, is provided at the rear of the convection fan 320 and convection heater 310.

In detail, the protecting member 350 not only protects the convection heater 310 and convection fan 320, but also functions to fix the positions of the convection heater 310 and convection fan 320.

Also, an intermediate member 360, for coupling the protecting member 350, is further provided between the cavity rear wall 11*a* and the protecting member 350.

Here, the intermediate member 360 may be welded to the cavity rear wall 11*a*, or the protecting member 350 may be fastened to the intermediate member 360 with screws. Here, in addition to welding, the intermediate member 360 may be coupled to the cavity 11 using various other methods.

In the present embodiment, in addition to advantages derivable from the use of a plurality of convection assemblies, by integrally forming the cavity 11 with the covering portion 340, a cleaner finishing of the cavity's inner surface can be realized. Also, the infiltration of impurities in gaps formed at the coupled portion of a covering member and the cavity when a covering member is fastened to the front surface of the cavity 11 can be prevented.

Figure 9:
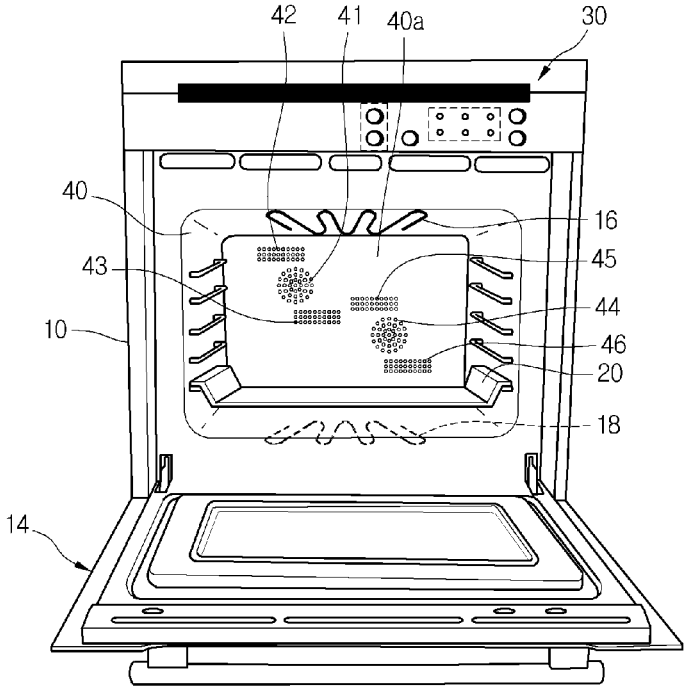
FIG. 9 is a schematic perspective view of an oven according to a fourth embodiment.
Figure 10:
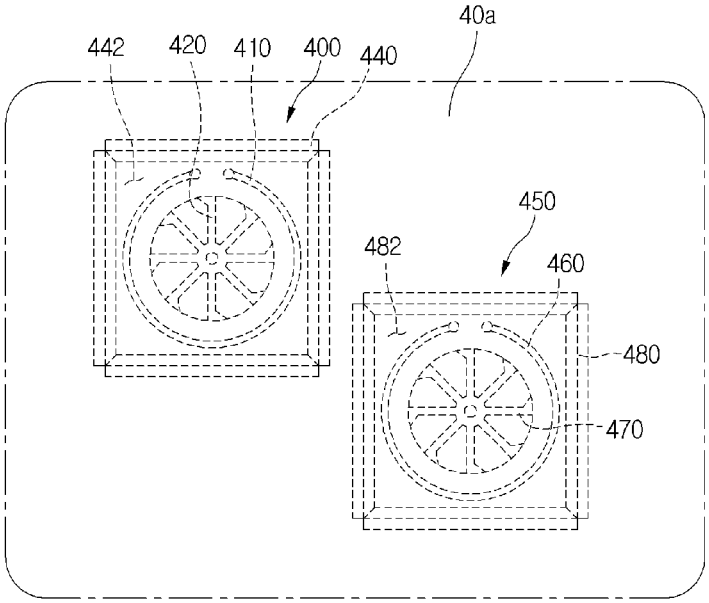
FIG. 10 is a frontal view showing the structure of a convection assembly according to the fourth embodiment.
Figure 11:
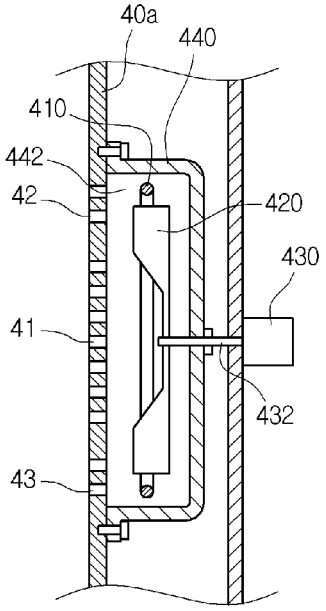
FIG. 11 is a sectional view showing the structure of a convection assembly according to the fourth embodiment.

FIG. 9 is a schematic perspective view of an oven according to a fourth embodiment, FIG. 10 is a frontal view showing the structure of a convection assembly according to the fourth embodiment, and FIG. 11 is a sectional view showing the structure of a convection assembly according to the fourth embodiment.

The present embodiment is the same in all other aspects as the first embodiment, with the exception of the location of the convection assembly and the covering member. That is, the respective positions of a plurality of convection assemblies is the same as in the first embodiment. Thus, a description below will address only characteristic aspects of the present embodiment, and aspects that are the same as in the first embodiment shall be deemed described by the latter.

Referring to FIGS. 9 to 11, a plurality of convection assemblies 400 and 450 according to the present embodiment are disposed at the rear of the cavity 40. Suctioning holes 41 and 44 and discharging holes 42, 43, 45, and 46 are formed in the rear wall 40*a* of the cavity 40 to allow air to flow by means of each convection assembly 400 and 450.

In detail, the plurality of convection assemblies 400 and 450 includes a first convection assembly 400 and a second convection assembly 450.

The first convection assembly 400 includes a first convection heater 410, a second convection fan, and a first covering member 440 fastened to the outside of the cavity 40. The second convection assembly 450 includes a second convection heater 460, a second convection fan 470, and a second covering member 480 fastened to the outside of the cavity 40.

Below, the structure of the first convection assembly 400 will be described with reference to FIG. 9. However, the "first" will be omitted from the description of the (first) convection assembly 400.

In detail, the covering member 440 is fastened to the rear wall 40*a* of the cavity 40 at the rear of the cavity 40. Thus, a heating chamber 442 that is a space in which air is heated is defined by the rear wall 40*a* of the cavity 40 and the covering member 440.

Also, a convection heater 410 and a convection fan 420 are disposed in the heating chamber 442.

That is, the convection heater 410 and the convection fan 420 are provided outside the cavity 40, and the convection fan 420 is coupled to a motor 430 through a shaft 432 passing therethrough from behind the covering member 440.

A suctioning hole 41 is formed in the rear wall 40*a* of the cover, through which air from the cooking chamber is suctioned, and upper and lower discharging holes 42 and 43 are formed above and below the suctioning hole 41, to discharge air heated in the heating chamber 442 into the cooking chamber.

Therefore, the cooking chamber and heating chamber communicate through the suctioning hole and discharging hole, and the air heated in the heating chamber can circulate within the cooking chamber and the heating chamber.

Figure 12:
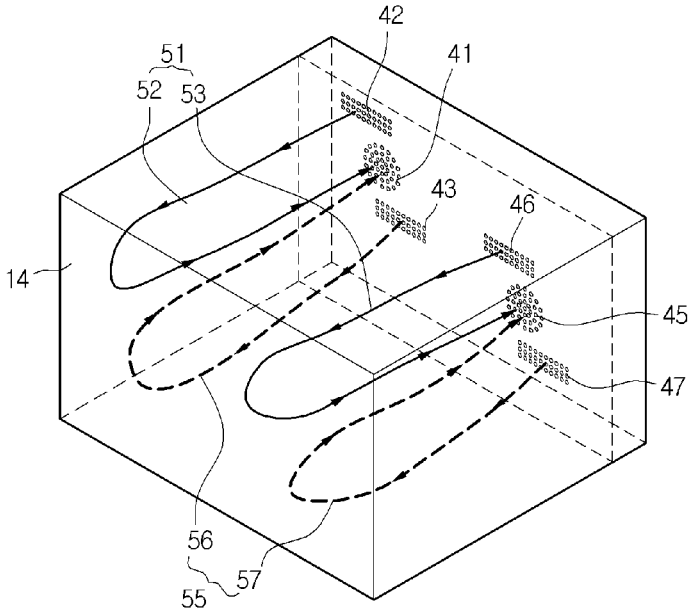
FIG. 12 is a diagram showing the flow of air within an oven according to the fourth embodiment.

FIG. 12 is a diagram showing the flow of air within an oven according to the fourth embodiment.

Referring to FIGS. 9 to 12, the cavity rear wall 11*a* defines suctioning holes for suctioning air into each heating chamber, and discharging holes for discharging air heated in each heating chamber to the inside of the cooking chamber.

In detail, the suctioning hole includes a first suctioning hole 41 through which air is suctioned to the first heating chamber 442, and a second suctioning hole 45 through which air is suctioned into the second heating chamber 482. Here, the installed heights of the convection fans 420 and 470 are different, and therefore, the positions of the respective suctioning holes 41 and 45 are obviously different.

The discharging holes include a first discharging hole 42 formed above the first suctioning hole 41, a second discharging hole 43 formed below the first suctioning hole 41, a third discharging hole 46 formed above the second suctioning hole 45, and a fourth discharging hole 47 formed below the second suctioning hole 45.

The first discharging hole 42 and the second discharging hole 43 are point symmetrically disposed about the shaft of the first convection fan 420, and the third discharging hole 46 and the fourth discharging hole 47 are point symmetrically disposed about the shaft of the second convection fan 470.

The location of the first discharging hole 42 is higher than that of the third discharging hole 46, and the location of the second discharging hole 43 is higher than that of the fourth discharging hole 47.

Below, the operation of the oven will be described.

When a user places food inside the cavity 40 and presses a start button, each convection heater 410 and 460 radiates heat, and each convection fan 420 and 470 is rotated.

Then, air within the cavity 40 is suctioned through each suctioning hole 41 and 46 into the respective heating chambers 442 and 482. The air suctioned into the respective heating chambers 442 and 482 is heated in each heating chamber 410 and 460, and is re-introduced into the cavity 40 through the discharging holes 42, 43, 46, and 47.

When air is thus circulated by the respective convection assemblies, a laminar airflow is formed within the cooking chamber.

That is, the laminar airflow includes an upper laminar airflow 51 and a lower laminar airflow 55. The upper laminar airflow 51 includes a first loop 51 and a second loop 53, and the lower laminar airflow 55 includes a third loop 56 and a fourth loop 57.

In further detail, the first loop 52 is formed of air that is discharged through the first discharging hole 42 into the cavity 40, flows along the top of the cavity 40 and meets the door 14, and is redirected to flow into the first heating chamber 442 through the first suctioning hole 41.

The second loop 53 is formed of air that is discharged through the third discharging hole 45 into the cavity 40, flows along the top of the cavity 40 and meets the door 14, and is redirected to flow into the second heating chamber 482 through the second suctioning hole 46.

The third loop 62 is formed of air that is discharged through the second discharging hole 43 into the cavity 40, flows along the bottom of the cavity 40 and meets the door 14, and is redirected to flow into the first heating chamber 442 through the first suctioning hole 41.

The fourth loop 57 is formed of air that is discharged through the fourth discharging hole 47 into the cavity 40, flows along the bottom of the cavity 40 and meets the door 14, and is redirected into the second heating chamber 482 through the second suctioning hole 45.

Here, the first loop 52 and the second loop 53 are given respectively different airflow patterns by the positional discrepancy between the first discharging hole 42 and the third discharging hole 46 and the positional discrepancy between the first suctioning hole 41 and the second suctioning hole 46.

The third loop 56 and the fourth loop 57 are given respectively different airflow patterns by the positional discrepancy between the second discharging hole 43 and the fourth discharging hole 47 and the positional discrepancy between the first suctioning hole 41 and the second suctioning hole 46.

That is, in the present embodiment, it may be said that each loop has a different airflow pattern, and the respectively different airflow patterns form laminar airflows. Resultantly, laminar airflows with respectively different patterns within the cooking chamber allow air within the cooking chamber to be evenly distributed throughout.

Similarly, in the present embodiment, the air heated by each convection heater 410 and 460 can be uniformly discharged into the cavity 40.

Figure 13:
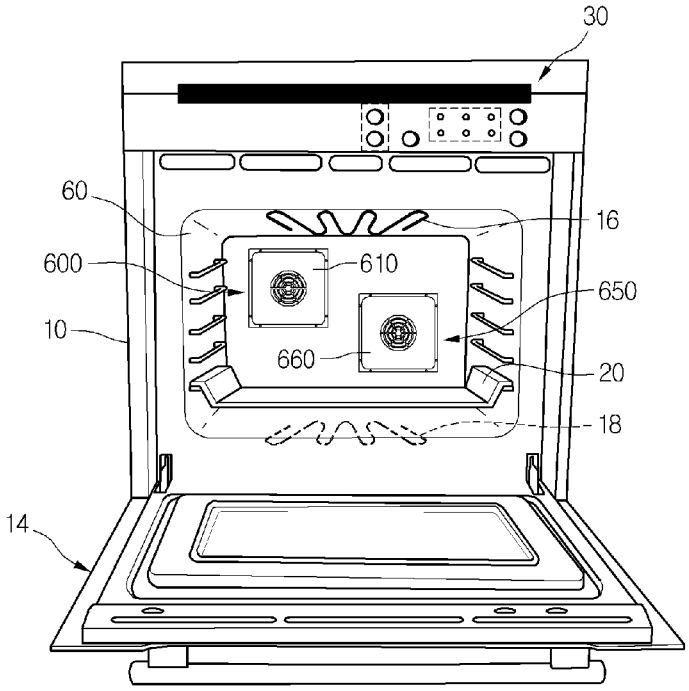
FIG. 13 is a schematic diagram of an oven according to a fifth embodiment.
Figure 14:
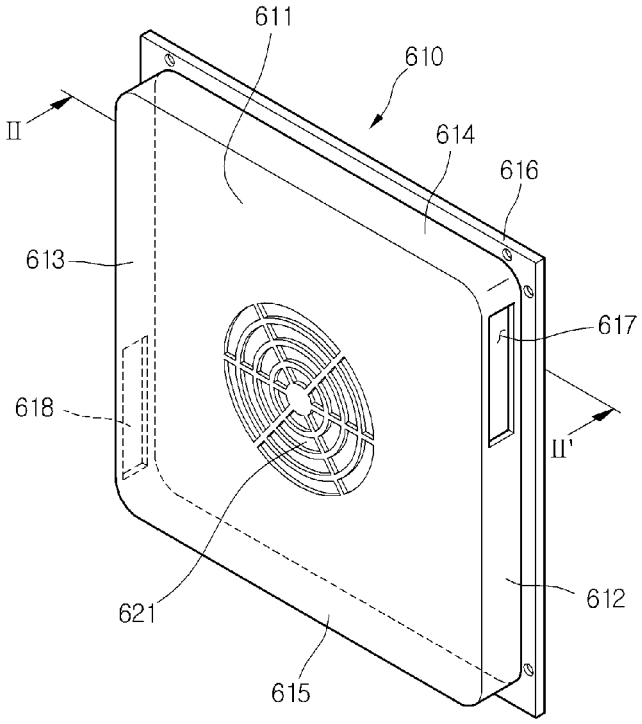
FIG. 14 is a perspective view of a covering member according to the fifth embodiment.
Figure 15:
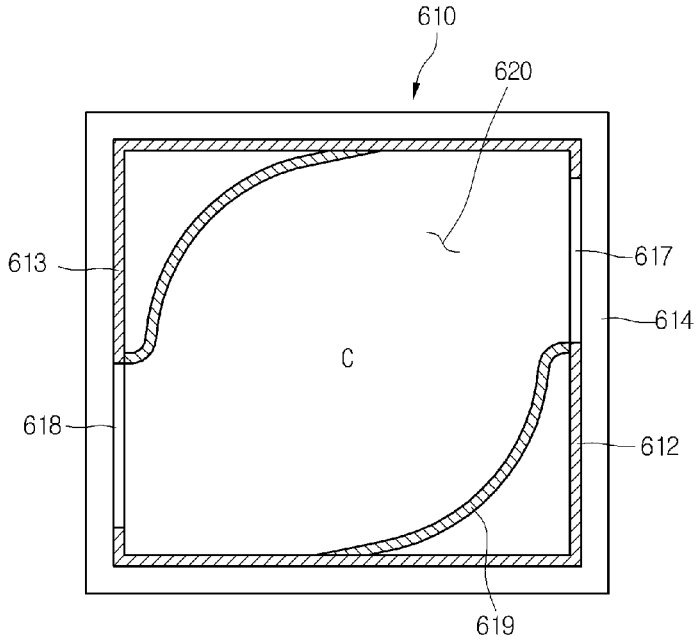
FIG. 15 is a sectional view of FIG. 14 taken along line II-II'.

FIG. 13 is a schematic diagram of an oven according to a fifth embodiment, FIG. 14 is a perspective view of a covering member according to the fifth embodiment, and FIG. 15 is a sectional view of FIG. 14 taken along line II-II'.

The present embodiment is the same in all aspects as the first embodiment except for the forming of the covering member. Thus, only a description of the difference characterizing the present embodiment will be described, and descriptions of aspects that are the same as those in the first embodiment shall be omitted and be deemed described by the first embodiment.

First, referring to FIG. 13, an oven according to the present embodiment includes a pair of convection assemblies 600 and 650. Covering members 610 and 650 are coupled to the rear of the cavity 60 to respectively cover a convection heater and convection fan that together form a convection assembly.

Referring to FIGS. 14 and 15, a detailed description of the structure of the covering members 610 and 650 will be provided below. In the present embodiment, each of the pair of covering members is formed the same, and therefore only a description of the covering member 610 on the left will be given.

The covering member 610 includes a square front portion 611, a peripheral portion extending perpendicularly rearward from the front portion 611, and a fastening portion 616 that fastens to the rear wall of the cavity 60.

In detail, the peripheral portion includes a pair of side portions 612 and 613 extending from either side of the front portion 611, and a top portion 614 and a bottom portion 615 extending from the top and bottom of the front portion 611.

Here, the side portions 612 and 613 face each other and are substantially parallel.

Also, the top portion 614 and the bottom portion 615 face one another and are substantially parallel.

A suctioning hole 621 is formed in the center of the front portion 611 to suction air from within the cavity 60 into a heating chamber 620. Here, the heating chamber 620 is a space defined by the cavity 60 and the covering member 610.

A discharging hole is formed in each of the side portions 612 and 613 to discharge air heated by the convection heater to the inside of the cavity 60.

In detail, the discharging holes include a first discharging hole 617 defined in an upper end of the right portion 612 of the covering member 610, and a second discharging hole 618 defined in a lower end of the left portion 613 of the covering member 610.

The discharging holes 617 and 618 are point symmetrically disposed about the center of the covering member 610. The discharging holes 617 and 618 are respectively formed in a vertically elongated manner.

Accordingly, when the convection fan rotates, the air heated by the convection heater is discharged at the right upper end and left lower end of the covering member 610 into the cavity 60.

Here, the first discharging hole 617 is defined in the right upper end of the covering member 610, and the second discharging hole 618 is defined in the left lower end of the covering member 610, so that the air heated by the convection heater is discharged in directions substantially tangential to the convection fan.

Also, a discharging guide 619, that prevents eddies occurring in the airflow within the heating chamber 620, and smoothly discharges air from the discharging holes 617 and 618, is formed on the covering member 610.

Figure 16:
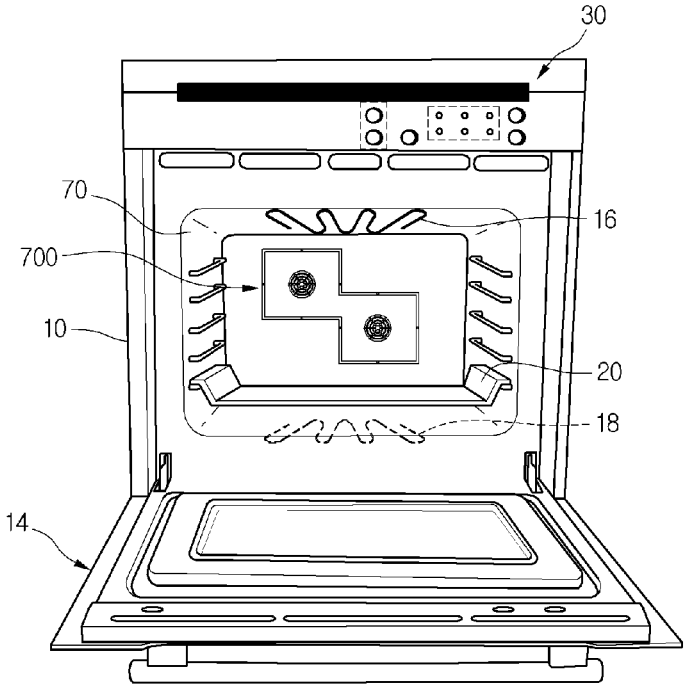
FIG. 16 is a diagram showing the schematic structure of an oven according to a sixth embodiment.
Figure 17:
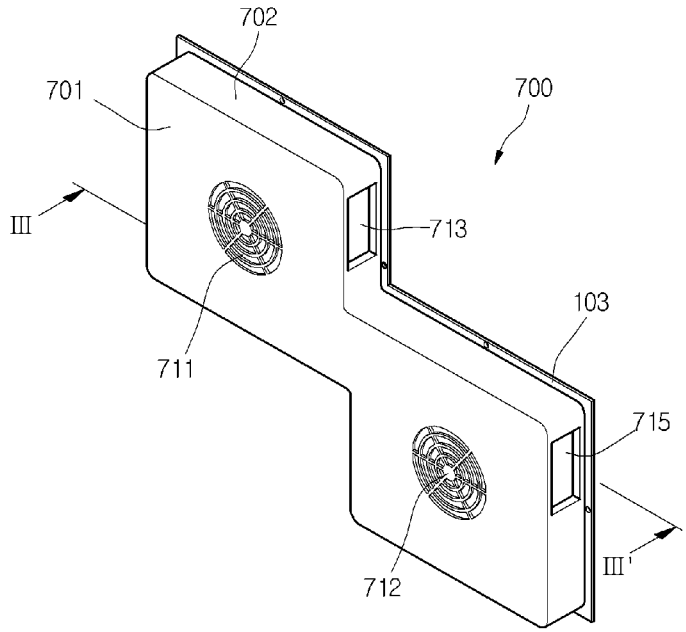
FIG. 17 is a perspective view of a covering member according to the sixth embodiment.
Figure 18:
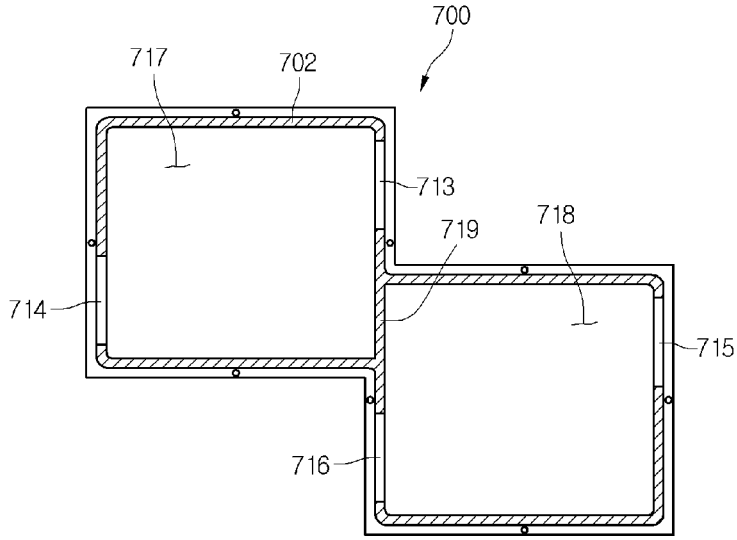
FIG. 18 is sectional view of FIG. 17 taken along line III-III'.

FIG. 16 is a diagram showing the schematic structure of an oven according to a sixth embodiment, FIG. 17 is a perspective view of a covering member according to the sixth embodiment, and FIG. 18 is sectional view of FIG. 17 taken along line III-III'.

The present embodiment is the same in all aspects as the first embodiment except for the structure of the covering member. Thus, only a description of the difference characterizing the present embodiment will be described, and descriptions of aspects that are the same as those in the first embodiment shall be omitted and be deemed described by the first embodiment.

Referring to FIGS. 16 to 18, in the present embodiment, one covering member 700 simultaneously covers a pair of convection heaters and a pair of convection fans.

That is, the covering member 700 includes a front portion 701, a peripheral portion 702 extending perpendicularly rearward from the front portion 701, and a fastening portion 703 extending from the peripheral portion 702 to fasten to the cavity 70.

A dividing portion 719 is formed on the covering member 700, so that the covering member 700 defines a first and second heating chamber 717 and 718, in concert with the rear wall of the cavity 70. Each heating chamber 717 and 718 includes a convection heater and a convection fan.

When the two heating chambers 717 and 718 are formed by the dividing portion 719 between the cavity and the covering member 700, air heated by the convection heaters located respectively in the heating chambers flows separately by means of the respective convection fans.

The front portion 701 includes a first suctioning hole 711 for suctioning air within the cavity into the first heating chamber 717, and a second suctioning hole 712 for suctioning air within the cavity into the second heating chamber 718.

Discharging holes are defined in the peripheral portion 702 to discharge air heated by the convection heater into the cavity 70.

That is, the discharging holes include a first discharging hole 713 formed in the right upper end of the first heating chamber 717, a second discharging hole 714 formed in the left lower end of the first heating chamber 717, a third discharging hole 715 formed in the right upper end of the second heating chamber 718, and a fourth discharging hole 716 formed in the left lower end of the second heating chamber 718.

The first discharging hole 713 and the second discharging hole 715 are point symmetrical about the center of the first heating chamber 717, and each discharging hole 713 and 714 is elongated vertically.

The third discharging hole 715 and the fourth discharging hole 716 are point symmetrical about the center of the second heating chamber 718, and each discharging hole 715 and 716 is elongated vertically.

When viewed in its entirety, the covering member 700 has two discharging holes 713 and 715 formed at different heights in the right side thereof, and two discharging holes 714 and 716 formed at different heights in the left side thereof. The discharging holes 713, 714, 715, and 716 have different heights, respectively.

Accordingly, when each convection heater and convection fan operates, the air heated by the respective convection heaters is discharged into the cavity 70 at respectively different heights, so that the air inside the cavity can be evenly distributed.

Figure 19:
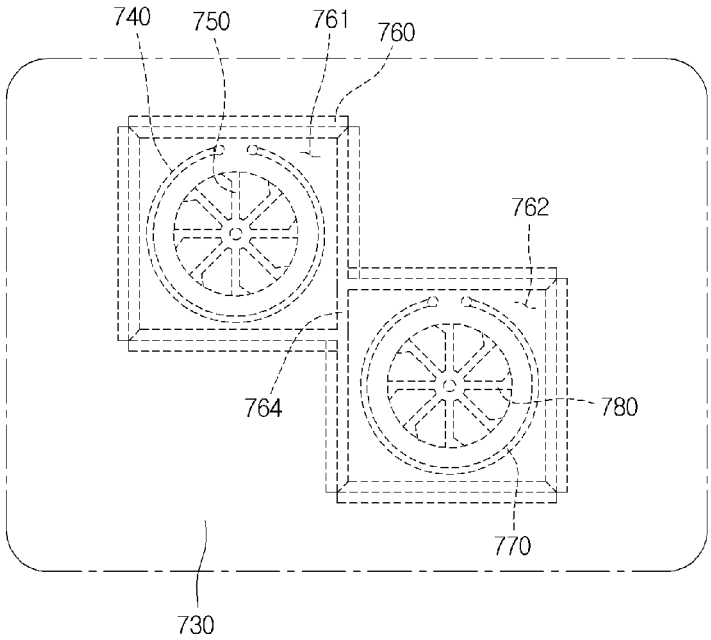
FIG. 19 is a diagram of a covering member according to a seventh embodiment.

FIG. 19 is a diagram of a covering member according to a seventh embodiment.

The present embodiment is the same in all aspects as the sixth embodiment except for the coupled position and structure of the covering member. Thus, only a description of the differences characterizing the present embodiment will be described. Also, the structure of the oven aside from the covering member is the same as that in the fourth embodiment, shown in FIG. 9.

Referring to FIGS. 9 to 19, a covering member 760 is coupled to a cavity 730 at the outside of the cavity 730.

A dividing portion 764 is formed on the covering member 760 to define a first and second heating chamber 761 and 762 between the covering member 760 and the cavity 730. The first heating chamber 761 includes a first convection heater 740 and a first convection fan 750 therein, and the second heating chamber 762 includes a second convection heater 770 and a second convection fan 780 therein.

Figure 20:
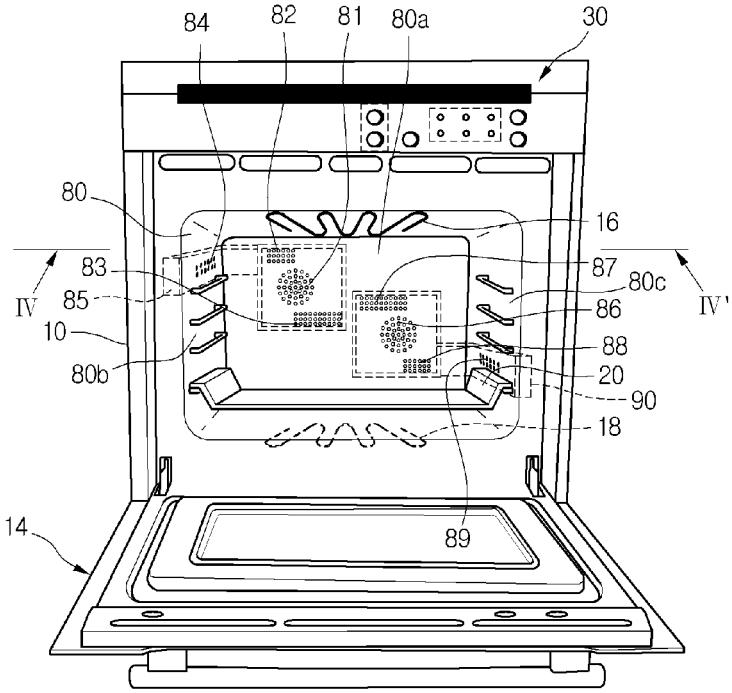
FIG. 20 is a schematic perspective view of an oven according to an eighth embodiment.
Figure 21:
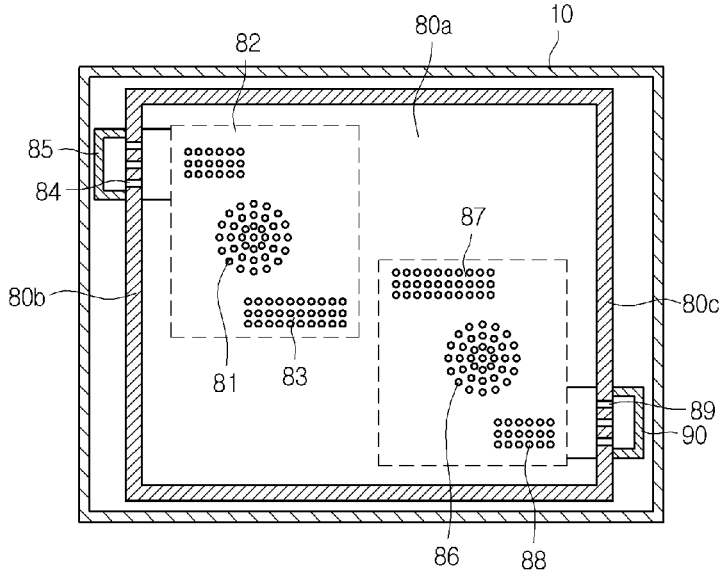
FIG. 21 is a sectional view of FIG. 20 taken along line IV-IV'.
Figure 22:
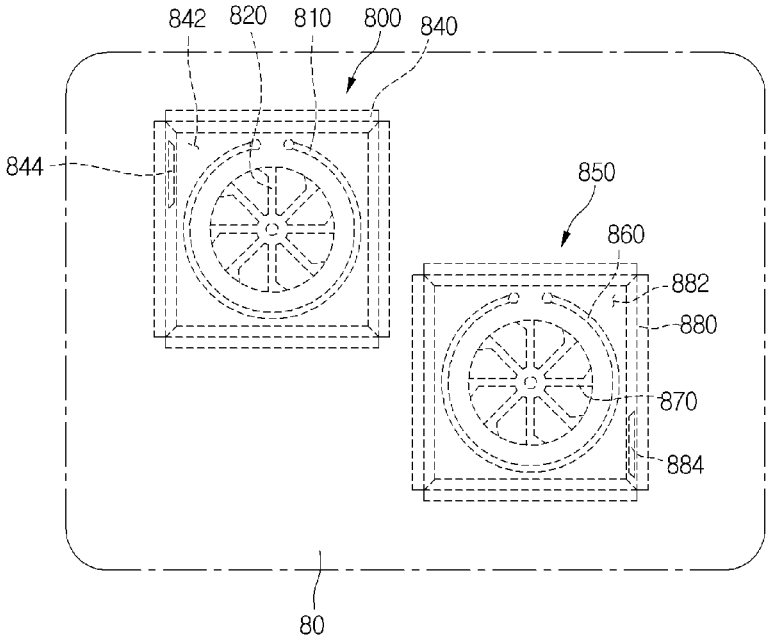
FIG. 22 is a diagram showing the structure of a convection assembly according to the eighth embodiment.

FIG. 20 is a schematic perspective view of an oven according to an eighth embodiment, FIG. 21 is a sectional view of FIG. 20 taken along line IV-IV', and FIG. 22 is a diagram showing the structure of a convection assembly according to the eighth embodiment.

The present embodiment is the same in all aspects as the fourth embodiment except for the positions of the discharging holes. Thus, only a description of the differences characterizing the present embodiment will be described.

Referring to FIG. 20, an oven according to the present embodiment discharges heated air from the rear and sides of the cavity 80.

In detail, a first and second suctioning hole 81 and 86 and a first through fourth discharging holes 82, 83, 87, and 89 are formed in the rear wall 80*a* of the cavity 80 to allow air to flow by means of a pair of convection assemblies 800 and 850 provided at the rear of the cavity 80.

Air heated by each convection heater 810 and 860 is discharged through first and second side discharging holes 84 and 89 defined respectively in either side 80*b* and 80*c* of the cavity 80. Here, the first side discharging hole 84 discharges air heated by one convection assembly 800, and the second side discharging hole 89 discharges air heated by the other convection assembly 850.

More specifically, a first communicating hole 844, communicating with a left flow guide 85 that allows air to flow to the first side discharging hole 84, is defined in the left upper end of a first covering member 840. A second communicating hole 884, communicating with a right flow guide 90 that allows air to flow to the second side discharging hole 89, is defined in the right lower portion of a second covering member 880.

Accordingly, a portion of the air suctioned into and heated by each heating chamber 842 and 882 passes through each rear discharging hole 82, 83, 87, and 88 to be discharged into the cavity 80. Another portion of the air passes through the respective communicating holes 844 and 884 to be discharged into the respective flow guides 85 and 90, after which the portion of air is discharged through the side discharging holes 84 and 89 into the cavity 80.

Thus, a portion of air suctioned into and heated by the heating chambers 842 and 882 is discharged through the respective rear discharging holes 82, 83, 87, and 88 into the cavity 80. Another portion of the air is discharged respectively through the communicating holes 844 and 884 into the respective flow guides 85 and 90, after which it is discharged through the respective side discharging holes 84 and 89 into the cavity 80.

The first suctioning hole 81 is formed at a higher position than the second suctioning hole 86. Also, the first rear discharging hole 82 is formed above the first suctioning hole 81, and the second rear discharging hole 83 is formed below the first suctioning hole 81.

The third rear discharging hole 87 is formed above the second suctioning hole 86, and the fourth rear discharging hole 88 is formed below the second suctioning hole 86.

The first rear discharging hole 82 is formed at a position higher than the third rear discharging hole 87, and the second rear discharging hole 83 is formed at a position lower than the fourth rear discharging hole 89.

The first side discharging hole 85 is formed in the left upper end of the cavity 80, and the second side discharging hole 89 is formed in the right upper end of the cavity 80. The first side discharging hole 85 is formed in a position corresponding to the first rear discharging hole 82, to minimize the airflow passage through which air heated by the first convection heater 810 flows. That is, the first side discharging hole 85 and the first rear discharging hole 82 are formed at the same height.

Likewise, the second side discharging hole 89 is formed in a position corresponding to the fourth rear discharging hole 88, to minimize the airflow passage through which air heated by the second convection heater 860 flows. That is, the second side discharging hole 89 and the fourth rear discharging hole 88 are formed at the same height.

Figure 23:
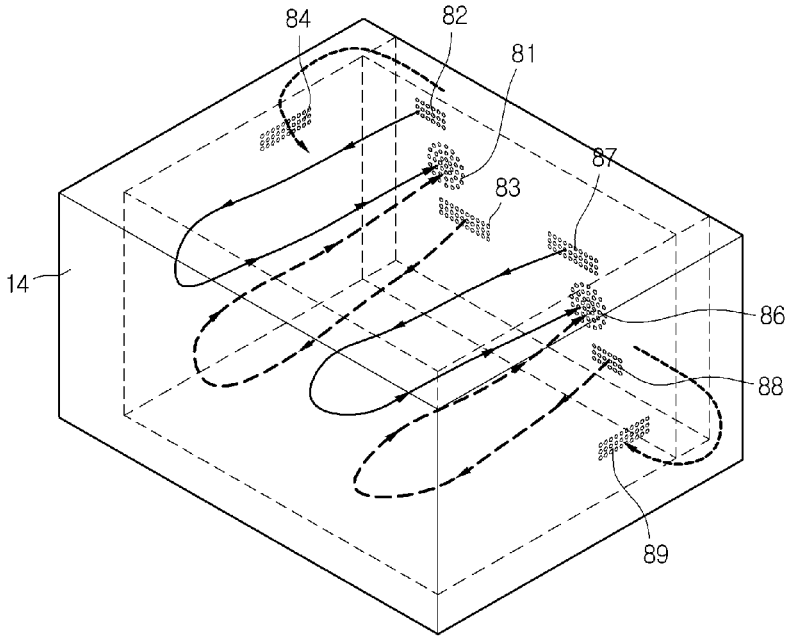
FIG. 23 is diagram showing the flow of air within an oven according to the eight embodiment.

FIG. 23 is diagram showing the flow of air within an oven according to the eight embodiment.

Referring to FIGS. 20 to 23, when a user puts food into the cavity 80 and presses a start button, each convection heater 810 and 860 generates heat and each convection fan 820 and 870 rotates.

Then, air inside the cavity 80 is suctioned through each suctioning hole 81 and 86 into each heating chamber 842 and 882, heated by each convection heater 810 and 860, and then discharged through each rear discharging hole 82, 83, 87, and 88 and each side discharging hole 84 and 89 to the inside of the cavity 80.

Here, after the air suctioned through each suctioning hole 81 and 86 is heated, the air is discharged through the rear discharging holes 82, 83, 87, and 88 into the cavity 80 in a series of circulating processes to form laminar airflow within the cavity 80.

The laminar airflow has already been described in the fourth embodiment, and will therefore not be described again.

Figure 24:
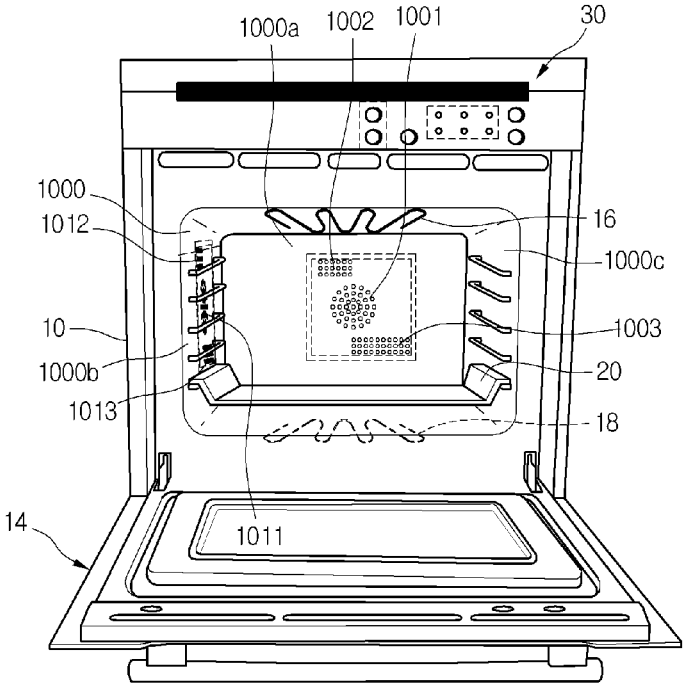
FIG. 24 is a schematic perspective view of an oven according to a ninth embodiment.
Figure 25:
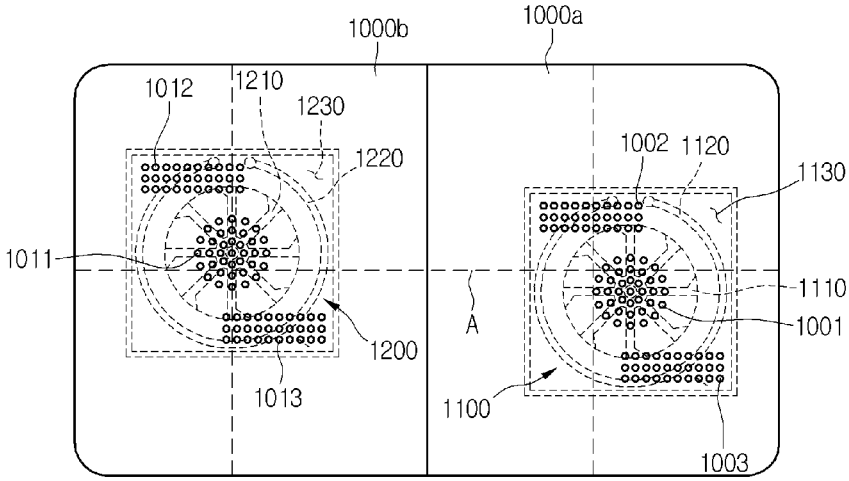
FIG. 25 is a diagram showing the geometric relation between a plurality of convection assemblies according to the ninth embodiment.

FIG. 24 is a schematic perspective view of an oven according to a ninth embodiment, and FIG. 25 is a diagram showing the geometric relation between a plurality of convection assemblies according to the ninth embodiment, where the left wall and the rear wall of the cavity in FIG. 25 share the same surface.

The present embodiment is the same in all aspects as the fourth embodiment except for the positions of the convection assemblies. Thus, only a description of the differences characterizing the present embodiment will be described.

Referring to FIGS. 24 and 25, in the present embodiment, a first convection assembly 1100 is provided at the rear of the cavity 1000, and a second convection assembly 1200 is provided at one side of the cavity 1000.

While the second convection assembly is described as being provided on the left side of the cavity 1000 in the present embodiment, it is not limited thereto, and the second convection assembly may be provided on the right side of the cavity 1000 instead.

Accordingly, air heated by the first convection assembly 1100 is discharged from the rear wall 1000*a* of the cavity, and air heated by the second convection assembly 1200 is discharged from a sidewall 1000*b* of the cavity.

That is, the rear wall 1000*a* of the cavity includes a first suctioning hole 1001 allowing air to flow toward the first convection assembly, and first and second rear discharging holes 1002 and 1003.

Also, a second suctioning hole 1011 allowing air to flow toward the second convection assembly 1200, and first and second side discharging holes 1012 and 1013 may be formed, for example, in a sidewall of the cavity 1000.

The first convection assembly 1100 includes a first convection fan 1110, and the second convection assembly 1200 includes a second convection fan 1210. The shaft of the first convection fan 1110 and the shaft of the second convection fan 1210 are disposed at different heights.

That is, shaft of the first convection fan 1110 is lower than the shaft of the second convection fan 1210 from the floor of the cavity 1000. In further detail, the shaft of the first convection fan 1110 is disposed below an imaginary horizontal centerline A dividing the cavity 1000 into two equal halves, and the shaft of the second convection fan is disposed above the centerline A.

The shaft of the first convection fan 1110 is disposed closer to the right wall 1000*c* of the cavity.

If the shaft of the first convection fan 1110 were disposed closer to the left wall 1000*b* of the cavity, air discharged through the side discharging holes 1012 and 1013 would immediately meet air discharged through the rear discharging holes 1002 and 1003, forming eddies. In this case, while the formation of eddies is not undesirable, the air discharged through the side discharging holes 1012 and 1013 would actually be unable to flow easily toward the right wall 1000*c* of the cavity.

Thus, in the present embodiment, the shaft of the first convection fan 1110 is disposed closer to the right wall 1000*c*, to enable the air discharged from the side discharging holes 1012 and 1013 to easily flow toward the right wall of the cavity.

The second suctioning hole 1011 is formed higher than the first suctioning hole 1001.

The rear discharging holes include a first rear discharging hole 1002 formed above the first suctioning hole 1001, and a second rear discharging hole 1003 formed below the first suctioning hole 1001. The side discharging holes include a first side discharging hole 1012 formed above the second suctioning hole 1011, and a second side discharging hole 1013 formed below the second suctioning hole 1011.

The first rear discharging hole 1002 and the second rear discharging hole 1003 are point symmetrical with respect to the shaft of the first convection fan 1110, and the first side discharging hole 1012 and the second side discharging hole 1013 are point symmetrical with respect to the second convection fan 1210.

The first side discharging hole 1012 is higher than the first rear discharging hole 1002, and the second side discharging hole 1012 is higher than the second rear discharging hole 1003.

Figure 26:
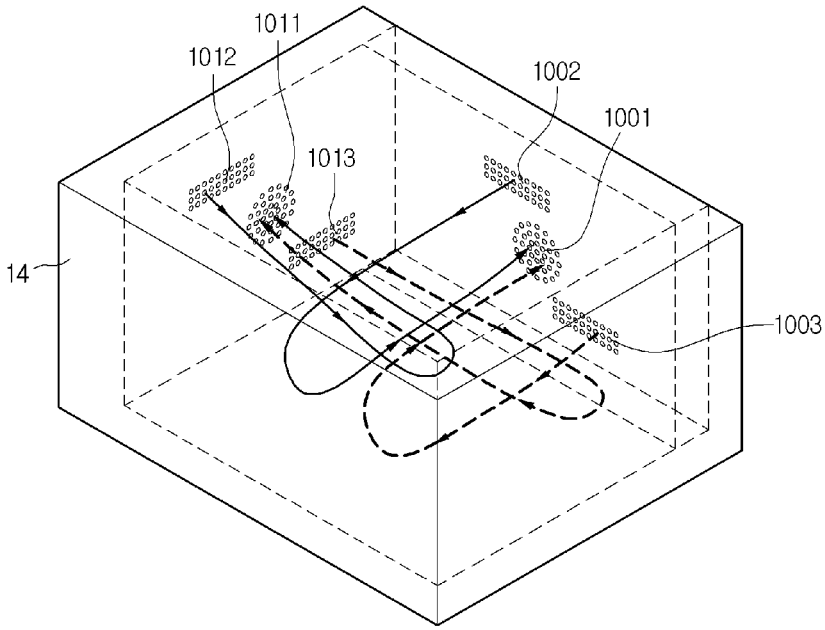
FIG. 26 is a diagram showing the flow of air within an oven according to the ninth embodiment.

FIG. 26 is a diagram showing the flow of air within an oven according to the ninth embodiment.

Referring to FIGS. 24 to 26, when a user inserts food into the cavity 1000 and presses a start button, each convection heater 1120 and 1220 generates heat and each convection fan 1110 and 1210 rotates. Then, the air inside the cavity 1000 is suctioned through the respective suctioning holes 1001 and 1011 into the respective heating chambers 1130 and 1230. The air suctioned into the heating chambers 1130 and 1230 is heated by the convection heaters 1120 and 1220, and then discharged through the rear discharging holes 1002 and 1003 and the side discharging holes 1012 and 1013 back into the cavity 1000.

In detail, the air that is discharged through the first side discharging hole 1011 meets the right wall 1000*c* of the cavity when it flows toward the top of the cavity, and is redirected and is suctioned through the second suctioning hole 1011 into the second heating chamber 1230.

The air discharged through the first side discharging hole 1002 flows along the top of the cavity and meets the door 14, whereupon it is redirected to be suctioned through the first suctioning hole 1001 into the first heating chamber 1130.

The air that is discharged through the second side discharging hole 1013 flows along the bottom of the cavity and meets the right wall 1000*c* of the cavity, whereupon it is redirected to be suctioned through the second suctioning hole 1011 into the second heating chamber 1230.

The air that is discharged through the second rear discharging hole 1003 flows along the bottom of the cavity and meets the door 14, whereupon it is redirected to be suctioned through the first suctioning hole 1001 into the first heating chamber 1130.

Here, the air discharged through the side discharging holes 1012 and 1013 flows toward the right wall of the cavity 1000, and the air discharged through the rear discharging holes 1002 and 1003 flows toward the door 14. The flow direction of the air discharged through the side discharging holes 1012 and 1013 and the flow direction of the air discharged through the rear discharging holes 1002 and 1003 are perpendicular.

However, because the respective side discharging holes 1012 and 1013 are formed higher than the respective rear discharging holes 1002 and 1003, the airflow discharged through the side discharging holes 1012 and 1013 and the airflow discharged through the rear discharging holes 1002 and 1003 do not actually meet until they are redirected. The airflow directions of these discharging holes only meet after they are redirected, created eddies.

In this case, the air discharged through the respective discharging holes 1002, 1003, 1012, and 1013 maintain their respective flow directions to heat food until the air is redirected, whereupon it creates eddies through colliding, so that it can evenly cook the food.

The invention claimed is:

1. An oven comprising:

a cavity receiving food;

a plurality of heaters that heat the food within the cavity;

a plurality of fans blowing air heated by the heater toward the food within the cavity; and at least one covering member covering simultaneously the heaters and the fans, wherein the fans have respective shafts that are different in height from a bottom surface of the cavity, wherein the covering member, together with the cavity, defines a heater chamber in which air is heated by the heater, and wherein the covering member includes a dividing portion dividing the heating chamber into a plurality of heating chambers.

2. The oven according to claim 1, wherein the covering member defines a plurality of discharging holes in a side thereof.

3. The oven according to claim 1, wherein a shaft of one of the fans is disposed below an imaginary horizontal centerline dividing the cavity into equal upper and lower halves, and a shaft of another of the fans is disposed above the imaginary horizontal centerline.

4. An oven comprising:

a cavity defining a cooking compartment;

a plurality of heaters and a plurality of fans within the cavity; and at least one covering member coupled to an inner side of the cavity, and covering at least one of the heaters and one of the fans, wherein the covering member defines at least one suctioning hole and at least one discharging hole, wherein the covering member simultaneously covers the heaters and the fans, wherein the covering member, together with the cavity, defines a heating chamber in which air is heated by the heater, and wherein the covering member includes a dividing portion dividing the heating chamber into a plurality of heating chambers.

5. The oven according to claim 4, wherein the covering member defines the suctioning hole in plurality.

6. The oven according to claim 4, wherein the fans have respective shafts with respectively different heights from a bottom surface of the cavity.

* * * * *